United States Patent [19]

Chillier-Duchatel et al.

[11] 4,160,287

[45] Jul. 3, 1979

[54] ELECTROLYZER POWER SUPPLY

[75] Inventors: Nicole Chillier-Duchatel, Sevres; Bernard Verger, Chevreuse, both of France

[73] Assignee: Societe Generale de Constructions Electriques et Mecaniques "Alsthom et Cie", Paris, France

[21] Appl. No.: 802,625

[22] Filed: Jun. 2, 1977

Related U.S. Application Data

[63] Continuation-in-part of Ser. No. 748,283, Dec. 7, 1976, abandoned.

[30] Foreign Application Priority Data

Dec. 12, 1975 [FR] France ..... 75 38151

[51] Int. Cl.[2] ..... H02M 7/28

[52] U.S. Cl. ..... 363/13; 361/436; 363/140

[58] Field of Search ..... 361/436; 363/13, 114, 363/140

[56] References Cited

U.S. PATENT DOCUMENTS

| | | | |
|---|---|---|---|
| 1,628,785 | 5/1927 | Keeler | 361/436 |
| 1,682,846 | 9/1928 | Kremers | 361/436 |
| 1,758,947 | 5/1930 | Hammond | 361/436 |
| 1,810,395 | 6/1931 | Engle | 361/436 |
| 1,889,417 | 11/1932 | Mershon | 361/436 |
| 1,918,526 | 7/1933 | Edelman | 361/436 X |
| 2,955,999 | 10/1960 | Tirrell | 361/436 X |

*Primary Examiner*—William M. Shoop
*Attorney, Agent, or Firm*—Flynn & Frishauf

[57] ABSTRACT

The invention concerns an electrolyzer power supply, especially for use in the industrial production of hydrogen. It is constituted by four sub-assemblies placed side-by-side in a filter-press type structure. These sub-assemblies each comprise electrodes coupled two by two, electrolytic compartments being defined between two groups of electrodes. One group of these electrodes, preferably half of them being made of a metal that has a rectifying effect on AC current, and preferably being aluminum, aluminum-zinc alloys, niobium or tantalum. The counter-electrodes are adapted to evolve oxygen. They are preferably iron, nickel or carbon. A generator providing an alternating current is connected between the end electrodes and between the second and third sub-assemblies. DC is taken from between the first and second and from between the third and fourth sub-assemblies.

14 Claims, 1 Drawing Figure

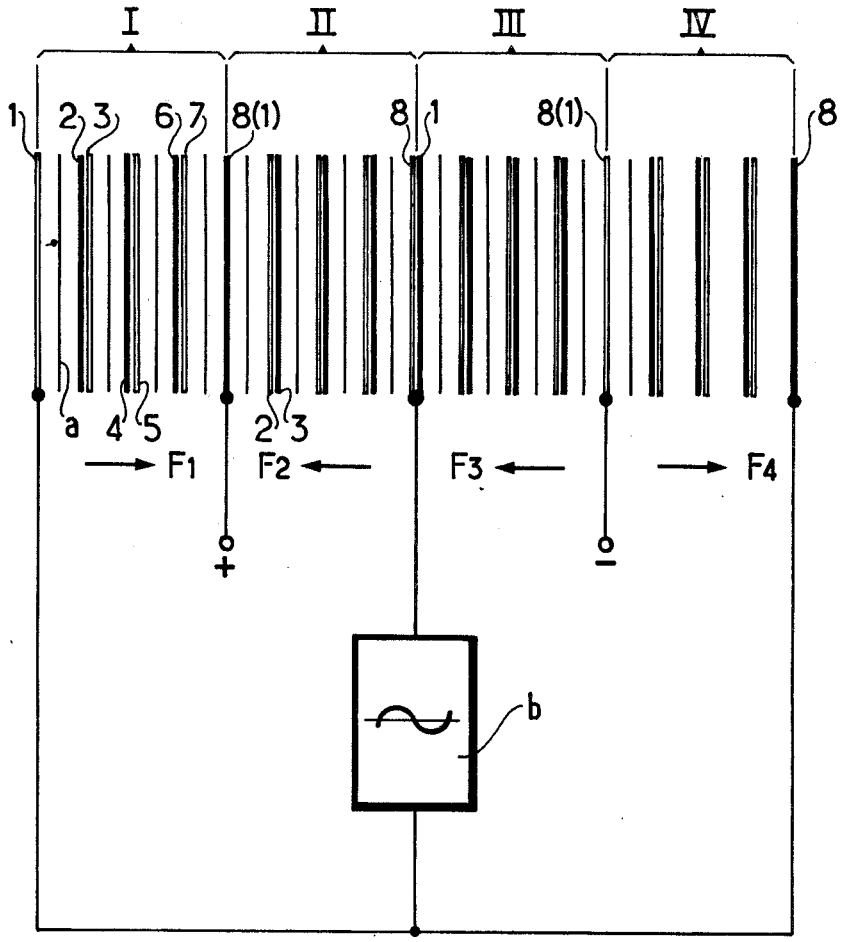
I
II
III
IV
1
2
3
6
7
8(1)
8
1
8(1)
8
a
4
5
2
3
F1
F2
F3
F4
+
−
b

ELECTROLYZER POWER SUPPLY

The application is a continuation-in-part of application Ser. no. 748,283 filed on Dec. 7, 1976, now abandoned.

The present invention relates to a power supply including electrolyzer rectifying elements. It is particularly intended for supplying DC to a conventional rectifier or rectifiers.

A known electrolyzing installation comprises, as main components, the electrolyzers themselves and a direct current supply system, which is principally composed of a transformer and alternating current rectifiers, together with associated cooling devices and regulators.

In a conventional installation it appears that the cost of each of these component groups is about the same order of magnitude. Therefore an improvement or simplification conferred to the supply system implies ipso facto an appreciable reduction of investment expenditure and of the cost price of the products obtained by electrolysis.

Thus, it would be possible to save a considerable amount of the investment cost and to reduce the cost price of products obtained by electrolysis if the conventional AC supply system is simplified.

The present invention therefore aims at a DC supply device for an electrolyzer capable of rectifying directly AC, i.e. without the use of a conventional rectifier system. Preferred embodiments of such a power supply consequently have a reduced cost price while keeping their efficiency and performance at a level closely comparable to those of conventional power supplies for use with the electrolyzers.

SUMMARY OF THE INVENTION

The present invention provides an electrolyzer power supply comprising four sub-assemblies placed side by side from the first to the fourth in a filter-press structure, each of these sub-assemblies comprising a plurality of electrodes including two end electrodes, the first end electrode of the first sub-assembly being one of the end electrodes of the filter-press structure, the second end electrode of the first sub-assembly and the first end electrode of the second sub-assembly being common, the second end electrode of the second sub-assembly being coupled to the first end electrode of the third sub-assembly, the second end electrode of the third sub-assembly and the first end electrode of the fourth sub-assembly being common, the second end electrode of the fourth sub-assembly being the second end electrode of the filter-press structure, said other (i.e. intermediate) electrodes being coupled two by two like the second end electrode of the second sub-assembly and the first end electrode of the third sub-assembly, said electrodes delimiting elementary cells in which flows an electrolyte, half of the electrodes of said device being made of a metal chosen among the group comprising zirconium, aluminum, aluminum zinc alloys, niobium and tantalum, whereas the other half of the electrodes are made of another conductive material, the electrodes being so distributed in the sub-assemblies that any electrode is made of a material different than that of a neighboring electrode, said device being provided with alternating current by a generator one of whose terminals is connected to said second end electrode of the second sub-assembly, whereas the other terminal of the generator is connected to said other end electrodes of the device as a whole, a direct current voltage capable of feeding an electrolyzer being taken out at terminals coupled to the end electrode common to the first and second and the end electrode common to the third and fourth sub-assembly.

BRIEF DESCRIPTION OF THE DRAWINGS

Further characteristics and advantages of the invention will be seen from the following description of a purely illustrative, but in no way limiting embodiment of the invention given with reference to the sole FIGURE of the accompanying drawing which illustrates an electrolyzer power supply device embodying the invention.

DETAILED DESCRIPTION

It is known that certain metals when immersed in an electrolyte show a rectifying effect in relation to AC. The rectifying effect results from a p-n junction between the metal and its oxide. The electrodes which have this rectifying effect are only conductive when they have a negative potential relative to the electrolyte. The overall effect is that as direct current passes through the cell from the electrolyte (or counter-electrode) to the electrode having the rectifying effect, hydrogen is evolved at said electrode having a rectifying effect. Oxygen is evolved at the counter-electrode. Thus, the electrodes having the rectifying effect are referred to as "negative" and the counter-electrodes are referred to as "positive".

The combination of an electrode having a rectifying effect and a counter-electrode both immersed in an aqueous electrolyte constitutes an elementary cell which when connected to an alternating current source functions as an electrolyzer evolving hydrogen at the electrode having the rectifying effect and oxygen at the counter-electrode. A further illustration of such a cell follows: An aluminum electrode and a nickel, iron, carbon, etc., electrode immersed in a borate or carbonate solution form a system which is analogous to a diode, i.e., it only allows alternate cycles of AC to pass, in the example it allows said alternate cycles to pass from the nickel or carbon electrode towards the aluminum electrode.

Metals such as zirconium, niobium and tantalum possess the same characteristics as aluminum, but in addition to that they can be used in conjunction with a larger number of electrolytes at any pH value.

The applicant therefore had the idea of using such metals for the electrodes of a power supply for an electrolyzer having advantageously a filter-press type structure and capable of feeding an industrial electrolyzer.

Referring to the single figure, an electrolyzer power supply device embodying the invention comprises four sub-assemblies designated I to IV placed side by side in a filter-press structure.

In this example each sub-assembly comprises eight electrodes numbered 1 to 8. The actual number of electrodes is chosen in relation to the electrical characteristics desired of the power supply, e.g., the reverse bias break-down voltage) and will therefore vary from one power supply to another.

In the sub-assembly I the end electrode 1 which is one of the end electrodes of the filter-press structure is made of, for example, nickel.

The next electrode 2 is opposite the electrode 1 (i.e. forms a second electrode of a single electrolyte containing cell) and is made of, for example, aluminum.

The third electrode 3 is in direct electrical contact with electrode 2 and is made of nickel. The electrodes 2 and 3 may form opposite faces of a laminated sheet or they may be physically separate, the important feature being that there is no electrolyte between to form a reverse oriented rectifying cell.

The electrode 4 is opposite the electrode 3 and is made of aluminium and so on.

In the second sub-assembly II, the end electrode 1 is common with the end electrode 8 of sub-assembly I and is therefore made of aluminium.

The electrode 2 (of sub-assembly II) is opposite the end electrode 1 and is made of nickel, the electrode 3 is in contact with the electrode 2 and is of aluminium and so on; the end electrode 8 being of nickel.

In sub-assembly III the end electrode 1 is of aluminum and in contact with the end electrode 8 of the preceding sub-assembly II. The sub-assembly III has a structure analogous to that of sub-assembly II, the end electrode 8 being therefore of nickel.

Finally, sub-assembly IV has its end electrode 1 in common with the electrode 8 of sub-assembly III and its structure is similar to that of sub-assembly I, the end electrode 8 thus being of aluminium and forming the other end electrode of the filter-press structure as a whole.

The spaces in these sub-assemblies extending between two opposite electrodes form elementary cells in which there flows an electrolyte, each of these cells being provided with a permeable membrane of diaphragm such as a.

The electrolyte is for example an aqueous solution of potash, of a carbonate or of a borate.

This device is supplied with alternating current by a generator b one of whose terminals is connected to electrodes 8 and 1 of sub-assemblies II and III respectively, while the other one of its terminals is connected to the end electrodes of the filter-press structure as a whole as illustrated.

As will be understood from the preceding description, electric current flows in the different sub-assemblies in directions indicated by arrows $F_1$, $F_2$, $F_3$, and $F_4$, and in each of the elementary cells oxygen is liberated at the nickel electrode, whereas hydrogen is liberated at the aluminium electrode.

It must be noted that iron, carbon, and carbon impregnated plastic electrodes can be used instead of the nickel electrodes, while the aluminum can be replaced by zirconium, niobium, tantalum, aluminum-zinc alloys, etc.

Whichever materials are actually chosen, DC may be taken from between the electrode 8 (1) common to sub-assemblies I and II and the electrode 8 (1) common to sub-assemblies III and IV.

The full-wave rectified DC can be used for supplying an electrolyzer of any known type, for instance of the filter-press type. In particular it can be used with an electrolyzer that does not include its own rectifying cells.

Advantageously the electrolyzer power supply is indeed used to supply an electrolyzer which is itself used for the production oxygen and hydrogen. In that case the quantities of oxygen and hydrogen generated by the operation of the power supply can be added to the quantities developed by the electrolyzer proper. These extra quantities may amount to nearly the same order of magnitude.

Water was electrolyzed to produce hydrogen and oxygen, utilizing zirconium as the negative electrode and nickel as the positive electrode, from a 30% KOH electrolyte with a current density of 0.5 amp per sq. cm., at 25° C. for 50 hours with uniform performance. The electrolyzer was also operated at 80° C.

Water was also electrolyzed using aluminum as the negative electrode and iron as the positive electrode from a saturated solution of neutral ammonium phosphate at ambient temperature with a current density above 10 amps per sq. decimeter.

Since the illustrated cells include bipolar electrodes, the terms "cathode" and "anode" are not used.

The negative electrodes are preferably zirconium, aluminum, niobium or tantalum. Alloys of these metals and other metals, e.g., aluminum-zinc alloys which similarly have the property of rectifying alternating current are also suitable.

The positive (counter-) electrodes are preferably nickel, iron, carbon, and carbon-containing.

The preferred aqueous electrolytes also contain at least one alkali metal cation or an ammonium cation. They also may contain one of the anions set forth hereinbefore. These ions in the electrolyte function to establish the pH and to render the electrolyte conductive. The electrolyte should not dissolve or otherwise corrode the electrodes or the oxide film thereon. Thus, a strong KOH electrolyte should not be used with aluminum.

The invention is not limited to the embodiments described and illustrated hereinabove which must be considered as examples only.

It is possible to make modifications to the details and to change certain arrangements or to replace certains means by equivalent ones.

We claim:

1. An electrolyzer power supply comprising a bridge rectifier circuit having four rectifying arms, each arm comprising a filter press structure group of series connected rectifying electrolyzer cells to form a full-wave bridge rectifier circuit, each of said series connected electrolyzer cells including a first negative electrode having a rectifying effect and a second counter-electrode and an electrolyte therebetween, the second electrode of a cell being electrically connected to the first electrode of the next series connected cell; said four groups being connected in series with first and second groups in series aiding and third and fourth groups in series aiding, the polarities of said first and second groups being connected with opposite polarities relative to said third and fourth groups, the end electrodes of said filter-press structure being interconnected to form an input electrode of the rectifier bridge and the other electrodes of the bridge comprising the intermediate end electrodes of said groups.

2. An electrolyzer power supply according to claim 1 wherein the negative electrodes of each rectifying electrolyzer cell are made from one of the metals selected from the group consisting of aluminum, niobium, tantalum, zirconium and aluminum-zinc alloys.

3. An electrolyzer power supply according to claim 2 wherein the counter-electrode of each rectifying electrolyzer cell is made from one of the materials selected from the group consisting of iron, nickel, carbon and carbon-impregnated plastics.

4. An electrolyzer power supply according to claim 1 wherein the counter-electrode of each rectifying electrolyzer cell is made from one of the materials selected from the group consisting of nickel, carbon and carbon impregnated plastics.

5. An electrolyzer power supply according to claim 3 wherein said electrolyte is an aqueous solution of an alkaline hydroxide.

6. An electrolyzer power supply according to claim 1 wherein said electrolyte is an aqueous solution of an alkaline hydroxide.

7. An electrolyzer power supply according to claim 3 wherein said electrolyte is aqueous solution of a carbonate or a borate.

8. An electrolyzer power supply according to claim 1 wherein said electrolyte is aqueous solution of a carbonate or a borate.

9. An electrolyzer power supply according to claim 1 wherein each group comprises a series connection of rectifying electrolysis cells with alternate rectifying electrodes being electrically connected to alternate counter-electrodes to form the series connection.

10. An electrolyzer power supply according to claim 9 wherein said output terminals each comprise an electrode connected in common to two adjacent rectifying electrolyzer cells belonging to two adjacent groups.

11. An electrolyzer power supply according to claim 1, wherein the intermediate groups of said filter-press structure comprises said first and second groups, and the end groups of said filter-press structure comprises said third and fourth groups; the end electrode of one electrode material of said first group being connected to the end electrode of the other electrode material of said second group to form a series aiding connection of said first and second groups, an input terminal being connected to the interconnection of said end electrodes of said first and second groups; said third and fourth groups having inner end electrodes which are common to the non-interconnected end electrodes of said first and second groups; said output terminals being coupled to said common inner-end electrodes; and means interconnecting the outermost end electrodes of said third and fourth groups together and for connecting another input terminal thereto, said source of AC electric power being applied across said input terminals, said outermost and interconnected electrodes of said third and fourth groups being electrodes of mutually different electrode material.

12. An electrolyzer power supply according to claim 11 wherein said negative electrodes are aluminum and said counter-electrodes are nickel electrodes.

13. An electrolyzer power supply according to claim 12 wherein said cells contain an aqueous electrolyte selected from the group consisting of an aqueous solution of an alkaline hydroxide, an aqueous solution of a carbonate or a borate.

14. An electrolyzer power supply according to claim 1 wherein said negative electrodes are aluminum and said counter-electrodes are nickel electrodes.

* * * * *